US005259892A

United States Patent [19]

Kubota et al.

[11] Patent Number: 5,259,892

[45] Date of Patent: Nov. 9, 1993

[54] PROCESS FOR PRODUCING NON-ORIENTED ELECTROMAGNETIC STEEL SHEET HAVING EXCELLENT MAGNETIC PROPERTIES AFTER STRESS RELIEF ANNEALING

[75] Inventors: Takeshi Kubota; Yozo Suga, both of Kitakyushu, Japan

[73] Assignee: Nippon Steel Corporation, Tokyo, Japan

[21] Appl. No.: 834,260

[22] PCT Filed: Jun. 12, 1991

[86] PCT No.: PCT/JP91/00792

§ 371 Date: Feb. 11, 1992

§ 102(e) Date: Feb. 11, 1992

[87] PCT Pub. No.: WO91/19821

PCT Pub. Date: Dec. 26, 1991

[30] Foreign Application Priority Data

Jun. 12, 1990 [JP] Japan ..... 2-153415

[51] Int. Cl.[5] ..... H01F 1/04

[52] U.S. Cl. ..... 148/111; 148/120

[58] Field of Search ..... 148/111, 113, 120

[56] References Cited

U.S. PATENT DOCUMENTS 3,770,517 11/1973 Gray et al. ..... 148/111

FOREIGN PATENT DOCUMENTS 54-76422 6/1979 Japan .
55-82732 6/1980 Japan .
57-203718 12/1982 Japan .
63-47332 2/1988 Japan ..... 148/111

*Primary Examiner*—John P. Sheehan
*Attorney, Agent, or Firm*—Kenyon & Kenyon

[57] ABSTRACT

The present invention relates to a process for producing a non-oriented electromagnetic steel sheet having excellent magnetic properties after stress relief annealing, which comprises, after hot rolling or hot-rolled sheet annealing, subjecting a steel comprising, on the weight basis, 0.010% or less of carbon and from 4.0 to 8.0% of silicon with the balance consisting of Fe and unavoidable impurity elements, to cold-rolling at a rolling temperature in the range of from 100° to 300° C. once or at least twice with intermediate annealing, subjecting the cold-rolled sheet to continuous annealing, and further subjecting the annealed sheet to skin pass rolling with a reduction ratio in the range of from 2 to 15%. This process can provide a non-oriented electromagnetic steel sheet having excellent magnetic properties even when the stress relief annealing is conducted for a short period of time.

4 Claims, No Drawings

PROCESS FOR PRODUCING NON-ORIENTED ELECTROMAGNETIC STEEL SHEET HAVING EXCELLENT MAGNETIC PROPERTIES AFTER STRESS RELIEF ANNEALING

TECHNICAL FIELD

The present invention relates to a process for producing a non-oriented electromagnetic steel sheet having excellent magnetic properties after stress relief annealing for use as an iron core material for electrical equipment, particularly to a process for producing a non-oriented electromagnetic steel sheet having excellent magnetic properties after stress relief annealing suitable as the so-called "semi-process type non-oriented electromagnetic steel sheet" which, in the production of the above-mentioned iron core, is subjected to stamping and then annealed to remove stamping strain and, at the same time, conducts recrystallization and crystal grain growth of the steel sheet to improve magnetic properties.

BACKGROUND ART

In recent years, there is a very strong demand for improvement in performance particularly in the field of a rotating machine, a medium or small size transformer, etc. For this reason, as described in, for example, Japanese Unexamined Patent Publication (Kokai) Nos. 54-76422, 55-82732 and 57-203718, in order to bring out magnetic properties of a non-oriented electromagnetic steel sheet as much as possible, a method wherein the stress relief annealing for removing stamping stress of a non-oriented electromagnetic steel sheet in the production of an iron core is utilized to simultaneously conduct the recrystallization and crystal grain growth of the steel sheet, thereby improving magnetic properties to attain substantially the same effect as that attained when use is made of a non-oriented electromagnetic steel sheet of higher grade, has widely been used in the art. For this purpose, a box or tunnel furnace wherein electricity or gas is used as a heating source has been generally used because the stress relief annealing should usually be conducted under conditions of a temperature in the range of from 700° to 850° C. and a soaking time of one hour or longer.

In the above-described conventional stress relief annealing method, however, the annealing including heating, soaking and cooling requires several hours or longer. Further, since the annealing is a batch process independent of a series of iron core manufacturing steps, it leads to an increase in the time necessary for the manufacturing process and an increase in the complexity of the manufacturing process, so that productivity is very poor.

In view of the above, an object of the present invention is to provide a process for producing a non-oriented electromagnetic steel sheet having excellent magnetic properties after stress relief annealing which can sufficiently attain an improvement in the desired magnetic properties even in stress relief annealing for a short period of time and improve productivity through a reduction in the time necessary for the manufacturing process and a simplification of the manufacturing process.

DISCLOSURE OF INVENTION

The present inventors have made extensive and intensive studies with focus of attention particularly on the relationship between the Si content and the crystal grain growing property with a view to improve the magnetic properties through the removal of stamping stress simultaneously with the recrystallization and crystal grain growth of the steel sheet in stress relief annealing for a short period of time by a combination of the above-mentioned relationship with manufacturing process conditions.

As a result, they have found that a proper combination of the selection of the Si content of the steel with skin pass rolling conditions allows for an improvement in the magnetic properties to be attained by stress relief annealing for a very short period of time, that is, 5 min or less, as opposed to the prior art wherein stress relief annealing for one hour or longer is necessary. The present invention has been made based on the above-described finding, and the subject matter thereof resides in that a steel comprising, on the weight basis, 0.010% or less of carbon and from 4.0% to 8.0% of silicon with the balance consisting of Fe and unavoidable impurity elements, is hot-rolled, cold-rolled at a rolling temperature in the range of from 100° to 300° C. once or at least twice with intermediate annealing, continuously annealed, and subjected to skin pass rolling with a draft of 2 to 15%. The subject matter resides also in the fact that prior to the cold rolling, the hot-rolled sheet is annealed at a temperature in the range of from 750° to 1200° C. for 15 secs, to 5 min.

The present invention will now be described in more detail.

At the outset, the reason for the limitation of the components of the steel in the present invention will be described.

C is a harmful component that enhances the iron loss and is causes magnetic aging, so that the C content is limited to 0.010% or less.

Si has the effect of promoting the removal of stress and the growth of a crystal grain in the stress relief annealing to enable a sufficient improvement in the magnetic properties to be attained in stress relief annealing even for a short period of time when combined with the following skin pass rolling. In order to attain this effect, Si should be contained in an amount of 4.0% or more. However, an increase in the Si content causes rollability to deteriorate due to embrittlement of the steel. For this reason, the Si content is limited to 8.0% or less.

The components other than those described above are iron and unavoidable impurity elements. If necessary, Al, Mn, etc. may be added for the purpose of lowering iron loss through an enhancement of electrical resistance. In this case, Al should be contained in an amount of 0.1% or more. When the content exceeds 2.0%, the magnetic flux density lowers and the cost becomes high. For this reason, the Al content is limited to 2.0% or less. Mn as well should be contained in an amount of 0.1% or more. When the content exceeds 1.5%, the magnetic flux density lowers and the cost becomes high, so that the Mn content is limited to 1.5% or less.

The steel comprising the above-described components is melted in a converter, an electric furnace or the like, subjected to continuous casting or ingot-making followed by blooming to prepare a steel slab. Then, the steel slab is heated to a desired temperature and hot-rolled. After the hot rolling, the hot-rolled sheet may be directly cold-rolled without annealing. The annealing of the hot-rolled sheet, however, enables a further improved effect to be attained, that is, the magnetic flux density of the product is improved by about 300 gauss after stress relief annealing. For this reason, the annealing of the hot-rolled sheet should be conducted at a temperature in the range of from 750° to 1200° C. for 15 sec to 5 min. When the annealing temperature of the hot-rolled sheet is below 750° C., the effect attained is small. On the other hand, when the annealing temperature is above 1200° C., the effect is saturated and, further, productivity is lowered and the production cost becomes high. For this reason, the annealing temperature of the hot-rolled sheet is limited to 750° to 1200° C. Also when the hot-rolled sheet annealing time is less than 15 sec, the effect attained is small, while when the annealing time exceeds 5 min, the effect is saturated and productivity decreases and production costs increase. For this reason, the hot-rolled sheet annealing time is limited to 15 sec to 5 min.

The cold rolling is conducted once or at least twice with intermediate annealing. In this case, the rolling temperature should be in the range of from 100° to 300° C. When the rolling temperature is below 100° C., the steel sheet is liable to crack during cold rolling, which deteriorates the rollability of the steel. On the other hand, when the rolling temperature is above 300° C., the cold rolling effect is lost, which leads to a deterioration of the magnetic properties, accuracy of the sheet thickness, etc. a reduction of productivity and an increase in the production cost. After the cold rolling, the sheet is subjected to continuous annealing for recrystallization and growth of a crystal grain.

After the continuous annealing, the sheet is subjected to skin pass rolling with a reduction ratio of 2 to 15%, because when the reduction ratio is less than 2%, the crystal grain growth promoting effect in the stress relief annealing attained in a combination of the skin pass rolling with the Si content is so small that no satisfactory improvement in the magnetic properties can be attained in stress relief annealing for a short period of time. Also when the reduction ratio exceeds 15%, the crystal grain growth promoting effect in the stress relief annealing is reduced and the stamping quality deteriorates. The skin pass rolling may be conducted at room temperature.

BEST MODE FOR CARRYING OUT THE INVENTION

The best mode for carrying out the invention will now be described in more detail with reference to the following Examples.

EXAMPLE 1

Steels listed in Table 1 were hot-rolled into a thickness of 2.3 mm and cold-rolled (rolling temperature: 150° C.) into a thickness of 0.230 mm in the case of the material not to be skin-pass-rolled and a thickness of 0.256 mm in the case of the material to be skin-pass-rolled, and subjected to continuous annealing at 850° C. for 30 sec. The material to be skin-pass-rolled was subjected to skin pass rolling with a reduction ratio of 10% and a thickness of 0.230 mm. Thereafter, these product sheets were cut into Epstein samples which were then subjected to stress relief annealing under conditions specified in Table 2 and subjected to a magnetic properties measurement. The results of measurement are also given in Table 2.

TABLE 1

| Steel | Components of steel (wt. %) | | | | |
|---|---|---|---|---|---|
| No. | C | Si | Mn | S | N |
| 1 | 0.003 | 0.9 | 0.2 | 0.002 | 0.002 |
| 2 | 0.003 | 3.1 | 0.2 | 0.002 | 0.002 |
| 3 | 0.004 | 6.4 | 0.2 | 0.001 | 0.002 |

It is apparent that no improvement in the magnetic properties can be attained when the steels (steel Nos. 1 and 2) comprising components outside the scope of the present invention are subjected to skin pass rolling followed by stress relief annealing for a short period of time (see Nos. 12 and 22 in Table 2).

TABLE 2

| No. | Steel | Skin pass reduction ratio | Stress relief annealing | $W_{10/50}$ [w/kg] | $W_{10/1000}$ [w/kg] | Remarks |
|---|---|---|---|---|---|---|
| 11 | 1 | 0% | 800° C. × 2 min | 1.3 | 83.4 | Comp. Ex. |
| | | | 800° C. × 2 hr | 1.1 | 67.1 | |
| 12 | 1 | 10% | 800° C. × 2 min | 1.2 | 82.3 | Comp. Ex. |
| | | | 800° C. × 2 hr | 0.9 | 64.6 | |
| 21 | 2 | 0% | 800° C. × 2 min | 1.2 | 64.7 | Comp. Ex. |
| | | | 800° C × 2 hr | 1.0 | 53.8 | |
| 22 | 2 | 10% | 800° C. × 2 min | 1.1 | 63.5 | Comp. Ex. |
| | | | 800° C. × 2 hr | 0.8 | 51.5 | |
| 31 | 3 | 0% | 800° C. × 2 min | 0.8 | 42.1 | Comp. Ex. |
| | | | 800° C. × 2 hr | 0.7 | 34.5 | |
| 32 | 3 | 10% | 800° C. × 2 min | 0.6 | 32.8 | Present |
| | | | 800° C. × 2 hr | 0.6 | 33.0 | invention |

It is apparent that according to the present invention, even when the stress relief annealing is conducted for a very short period of time, magnetic properties of the same level as that obtained in the conventional stress relief annealing for a long period of time can be obtained and it is possible to produce a non-oriented electromagnetic steel sheet having excellent magnetic properties after stress relief annealing.

EXAMPLE 2

Steel listed in Table 3 were hot-rolled at 900° C. for 2.5 min into a thickness for 2.0 mm, cold-rolled (rolling temperature: 200° C.) into a thickness of 0.212 mm, subjected to continous annealing at 900° C. for 20 sec, and subjected to skin pass rolling with a reduction ratio of 6% to have a thickness of 0.200 mm. Thereafter, these product sheets were cut into Epstein samples which were then subjected to stress relief annealing under conditions specified in Table 4 and subjected to a magnetic properties measurement. The results of measurement are also given in Table 4. It is apparent that according to the present invention, even when the stress relief annealing is conducted for a very short period of time, magnetic properties of the same level as that obtained in the conventional stress relief annealing for a long period of time can be obtained and it is possible to produce a non-oriented electromagnetic steel sheet having excellent magnetic properties after stress relief annealing.

TABLE 3

| Steel No. | Components of steel (wt. %) C | Si | Mn | Al | S | N |
|---|---|---|---|---|---|---|
| 4 | 0.002 | 0.3 | 0.2 | 0.3 | 0.002 | 0.003 |
| 5 | 0.002 | 1.9 | 0.2 | 0.3 | 0.003 | 0.003 |
| 6 | 0.002 | 4.6 | 0.2 | 0.3 | 0.002 | 0.002 |

TABLE 4

| Steel No. | Strain relief annealing | $W_{10/50}$ [w/kg] | $W_{10/1000}$ [w/kg] | Remarks |
|---|---|---|---|---|
| 4 | 800° C. × 30 sec | 1.3 | 81.0 | Comp. Ex. |
| | 790° C. × 1 hr | 1.0 | 63.7 | |
| 5 | 800° C. × 30 sec | 1.2 | 64.1 | Comp. Ex. |
| | 790° C. × 1 hr | 0.9 | 54.6 | |
| 6 | 800° C. × 30 sec | 0.7 | 34.6 | Present |
| | 790° C. × 1 hr | 0.7 | 34.1 | invention |

INDUSTRIAL APPLICABILITY

As described above, according to the present invention, it is possible to produce a non-oriented electromagnetic steel sheet having excellent magnetic properties after stress relief annealing that can improve the desired magnetic properties in stress relief annealing even for a short period of time and can improve the productivity through a reduction in the time necessary for the manufacturing process and a simplification of the manufacturing process. Thus, it is possible to sufficiently cope with the demand accompanying an increase in the performance and an increase in the efficiency of electrical equipment on the non-oriented electromagnetic steel sheet used as an iron core material in the electrical equipment, which renders the effect of the present invention very valuable from the viewpoint of industry.

We claim:

1. A process for producing a non-oriented electromagnetic steel sheet having excellent magnetic properties comprising hot-rolling a steel comprising, on a weight basis, 0.010% or less of carbon and from 4.0 to 8.0% of silicon with the balance consisting of Fe and unavoidable impurity elements, cold-rolling the hot-rolled sheet at a rolling temperature in the range of from 100° to 300° C. once or at least twice with intermediate annealing, subjecting the cold-rolled sheet to continuous annealing, and further subjecting the annealed sheet to skin pass rolling with a reduction ratio in the range of from 2 to 15%.

2. A process according to claim 1, wherein after the hot rolling, the hot-rolled sheet is annealed at a temperature in the range of from 750° to 1200° C. for 15 sec to 5 min.

3. A process according to claim 1, wherein after the skin pass rolling, stress relief annealing is conducted at a temperature in the range of from 700° to 900° C. for 15 sec to 5 min.

4. A process according to claim 1, wherein after the skin pass rolling, the steel sheet is subjected to stress relief annealing.

* * * * *